US007409725B1

(12) United States Patent
Horstman

(10) Patent No.: US 7,409,725 B1
(45) Date of Patent: Aug. 12, 2008

(54) KNEE PROTECTING APPARATUS

(76) Inventor: Kenneth R. Horstman, 2970 E. Baker Rd., Midland, MI (US) 48642

( * ) Notice: Subject to any disclaimer, the term of this patent is extended or adjusted under 35 U.S.C. 154(b) by 16 days.

(21) Appl. No.: 11/593,620

(22) Filed: Nov. 7, 2006

(51) Int. Cl.
*A41D 13/00* (2006.01)

(52) U.S. Cl. ..... 2/22

(58) Field of Classification Search ..... 2/22–24, 2/16, 62, 911; 602/16, 20, 23, 26
See application file for complete search history.

(56) References Cited

U.S. PATENT DOCUMENTS

| | | | | |
|---|---|---|---|---|
| 2,448,427 | A | 8/1948 | Gordon | |
| 3,112,812 | A * | 12/1963 | Ramon | 182/230 |
| 3,382,503 | A * | 5/1968 | Ramon | 2/24 |
| 4,789,046 | A * | 12/1988 | McDowall | 182/230 |
| 4,876,745 | A * | 10/1989 | Richards | 2/24 |
| 5,427,391 | A | 6/1995 | Cooper | |
| 5,652,957 | A | 8/1997 | Williford et al. | |
| D393,502 | S | 4/1998 | Peachey | |
| 5,829,055 | A | 11/1998 | Collins et al. | |
| 6,173,448 | B1 | 1/2001 | Kroposky | |
| 6,178,555 | B1 | 1/2001 | Williams | |
| 6,216,819 | B1 | 4/2001 | Cougar | |
| 6,256,787 | B1 | 7/2001 | Tyler | |
| 6,347,404 | B1 * | 2/2002 | Iskra | 2/24 |
| 6,789,264 | B2 * | 9/2004 | Budda | 2/22 |

* cited by examiner

*Primary Examiner*—Tejash Patel

(57) ABSTRACT

A knee protecting apparatus includes a top plate that is rigid and has a top side, a bottom side, a front edge, a rear edge, a first lateral edge and a second lateral edge. A panel for receiving a person's knee is attached to and selectively positioned on the top plate. A lower plate is resiliently compressible and has a same shape and size as the top plate. A coupler releasably couples the lower plate to the top plate. A knee strap extends through side edges of the panel. The knee strap is extendable around a leg of the person adjacent to the knee. Securing members releasably secure together free ends of the knee strap.

9 Claims, 5 Drawing Sheets

KNEE PROTECTING APPARATUS

BACKGROUND OF THE INVENTION

1. Field of the Invention

The present invention relates to knee protecting devices and more particularly pertains to a new knee protecting device for protecting a person's knees when they are kneeling and performing work duties.

2. Description of the Prior Art

The use of knee protecting devices is known in the prior art. While these devices fulfill their respective, particular objectives and requirements, the need remains for a device that not only protects the knees of a person while they kneel on a support surface, but may also be used to increase the friction between the person and the support surface when the support surface is angled to reduce slippage on the support surface.

SUMMARY OF THE INVENTION

The present invention meets the needs presented above by generally comprising a top plate that is rigid and has a top side, a bottom side, a front edge, a rear edge, a first lateral edge and a second lateral edge. A panel for receiving a person's knee is attached to and selectively positioned on the top plate. A lower plate is resiliently compressible and has a same shape and size as the top plate. A coupler releasably couples the lower plate to the top plate. A knee strap extends through side edges of the panel. The knee strap is extendable around a leg of the person adjacent to the knee. Securing members releasably secure together free ends of the knee strap.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
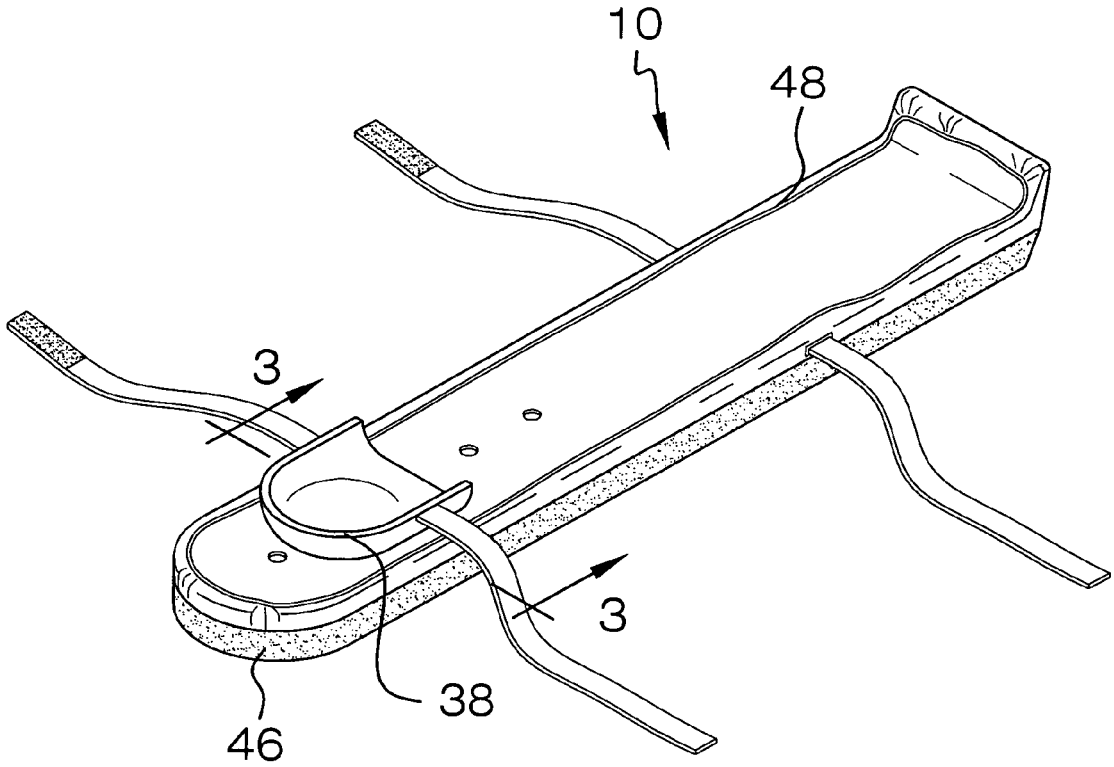
FIG. 1 is a perspective top view of a knee protecting apparatus according to the present invention.
Figure 2:
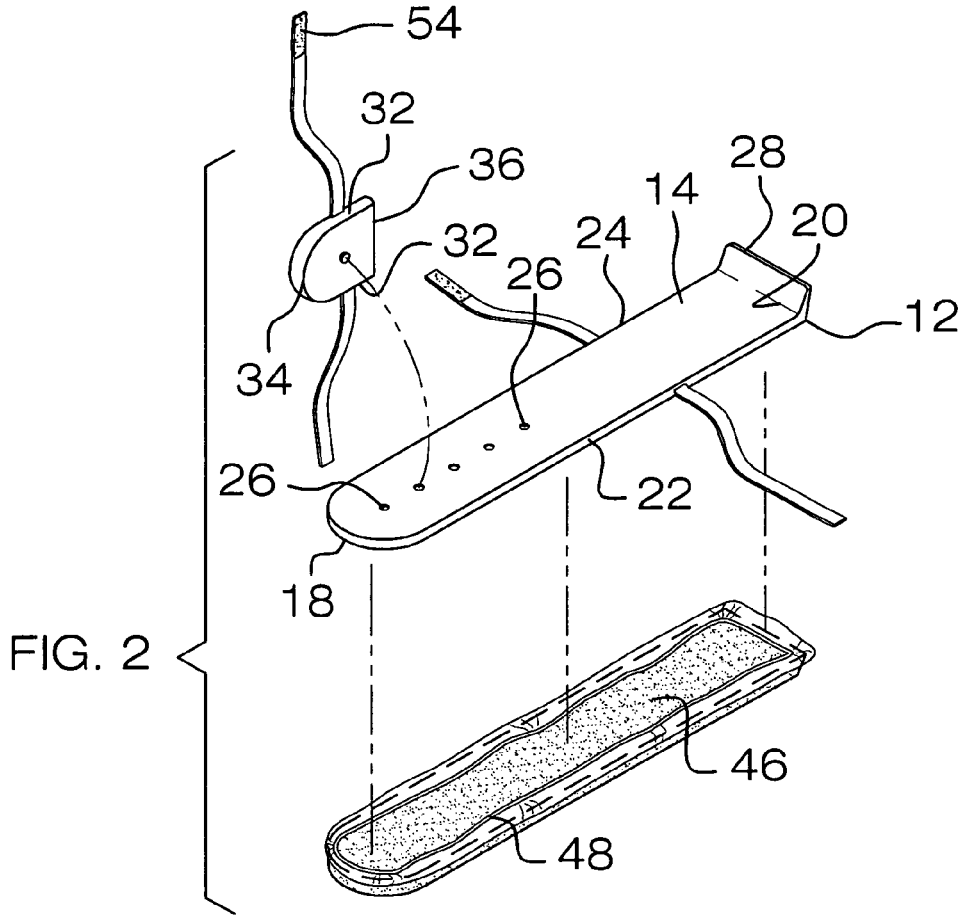
FIG. 2 is a perspective expanded view of the present invention.
Figure 3:
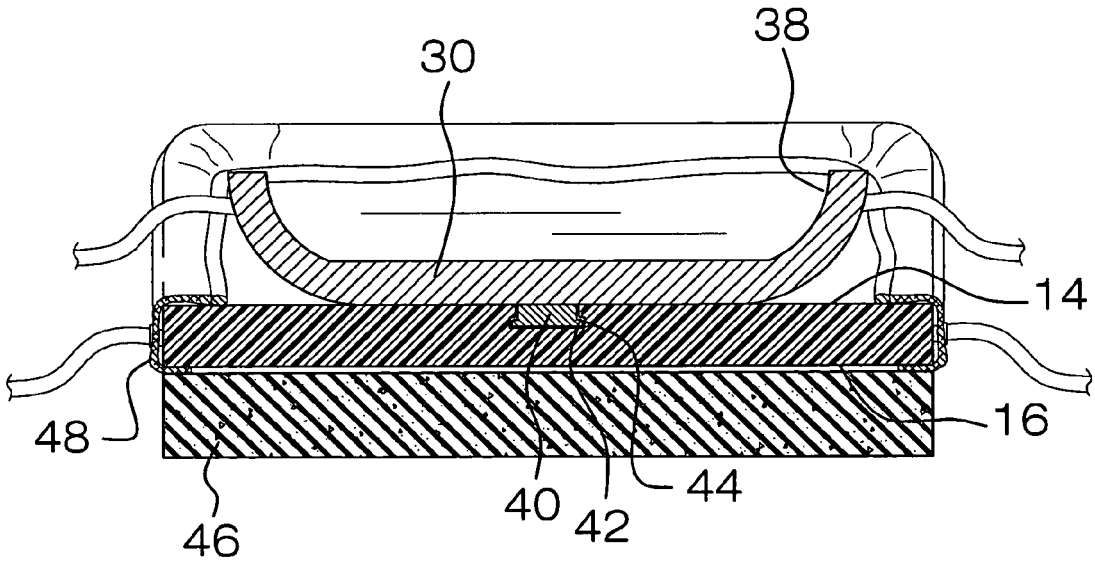
FIG. 3 is a cross-sectional view taken along line 3-3 of FIG. 1 of the present invention.
Figure 4:
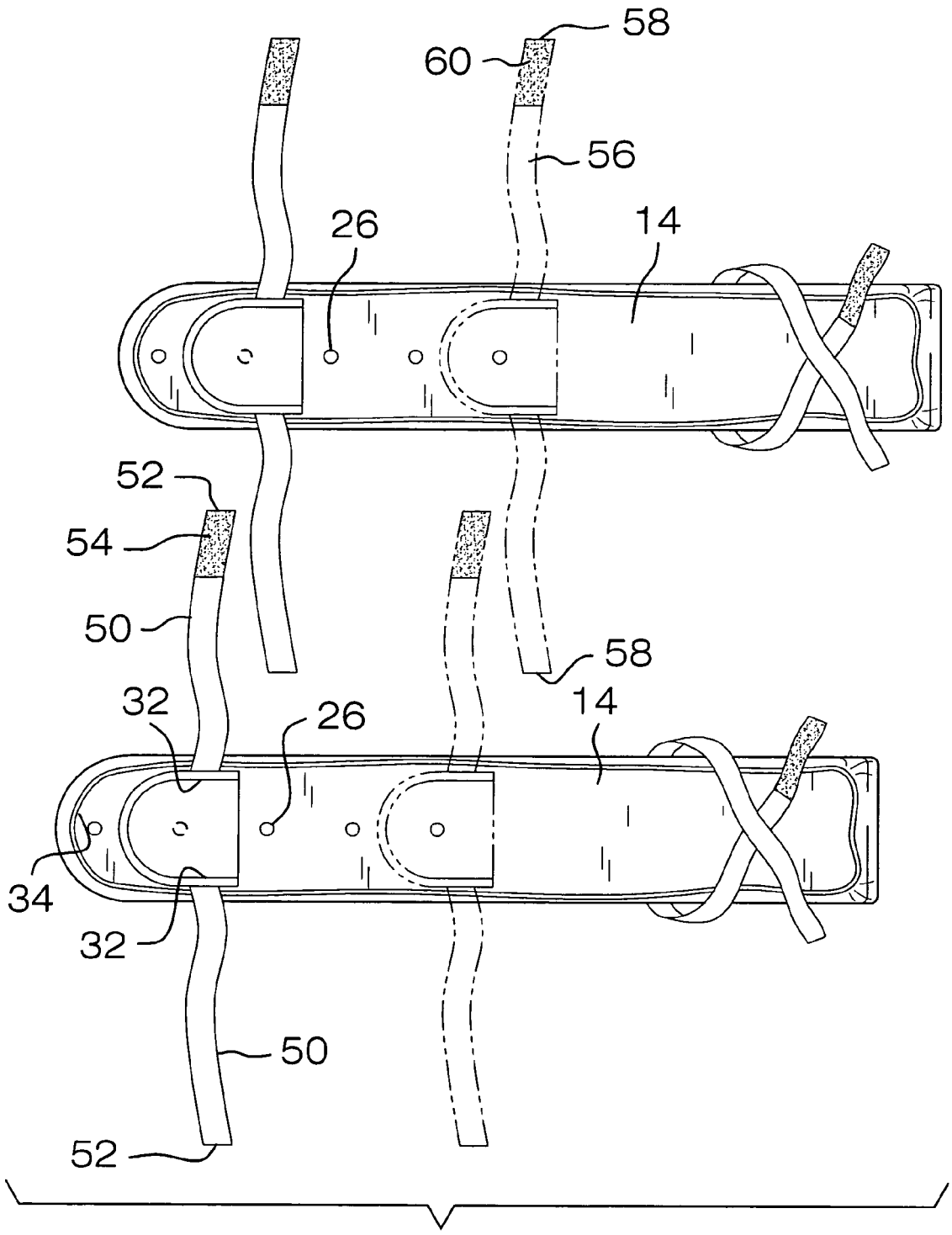
FIG. 4 is a top view of the present invention.
Figure 5:
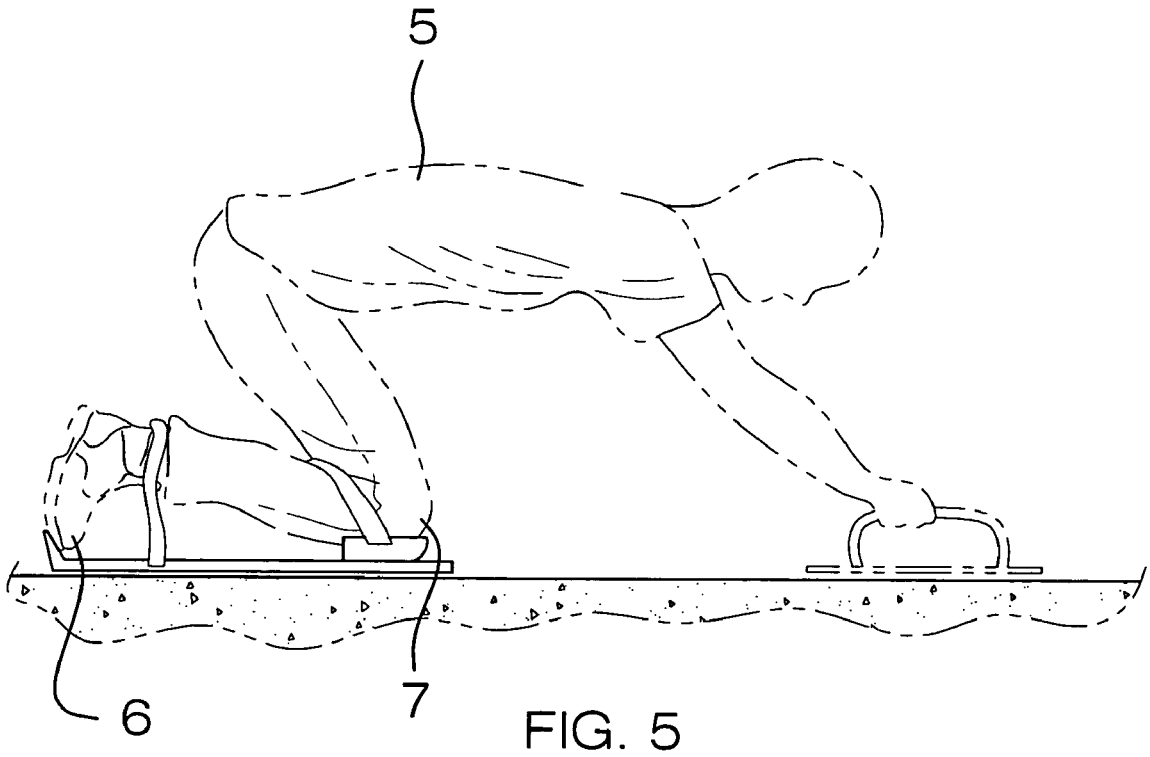
FIG. 5 is a side in-use view of the present invention.

With reference now to the drawings, and in particular to FIGS. 1 through 6 thereof, a new knee protecting device embodying the principles and concepts of the present invention and generally designated by the reference numeral 10 will be described.

As best illustrated in FIGS. 1 through 6, the knee 7 protecting apparatus 10 generally comprises a top plate 12 that is rigid and has a top side 14, a bottom side 16, a front edge 18, a rear edge 20, a first lateral edge 22 and a second lateral edge 24. The top side 14 has a plurality of receiving wells 26 therein aligned along a line orientated parallel to the first lateral edge 22. The receiving wells 26 are positioned nearer to the front edge 18 than the rear edge 20. A lip 28 is attached to and extends upwardly from the top side 14. The lip 28 is coextensive with the rear edge 20 and defines a toe support. Toes 6 of a user 5 of the apparatus 10 are positionable against the lip 28 to retain the person's foot on the top plate 12.

A panel 30 is provided for receiving the knee 7. The panel 30 is attached to and selectively positioned on the top plate 12. The panel 30 is comprised of a resiliently compressible material. The panel 30 has a pair of side edges 32, a forward edge 34 and a rearward edge 36. The forward edge 34 is directed toward the front edge 18 when the panel 30 is attached to the top side 14. An upwardly extending flange 38 is attached to and is coextensive with the side 32 and forward 34 edges of the panel 30. A male fastener 40 is attached to a lower surface of the panel 30. The male fastener 40 is positionable in one of the wells 26 and attached to the top plate. The male fastener 40 may include an outwardly extending catch 42 extendable into a notch 44 positioned in the wall of each of the wells 26.

A lower plate 46 is resiliently compressible and has a same shape and size as the top plate 12. The lower plate 46 is comprised of a foamed elastomeric material. A coupler 48 releasably couples the lower plate 46 to the top plate 12. The coupler 46 comprises a sleeve that is attached to the lower plate and is coextensive with a perimeter edge of the lower plate 46. The sleeve, or coupler 46, is extended over the front 18, rear 20, first lateral 22 and second 24 lateral edges of the top plate 12 to secure the lower plate 46 to the top plate 12.

A knee strap 50 extends through the side edges 32 of the panel 30. The knee strap 50 is extendable around a leg of the person 5 adjacent to the knee 7. Securing members 54 releasably secure together free ends 52 of the knee strap 50. The securing members 54 comprise a hook and loop securing assembly. A leg strap 56 extends through the first 22 and second 24 lateral edges of the top plate 12. The leg strap 56 is extendable around a leg of the person adjacent to a foot of the person 5. Securing members 60 also releasably secure together free ends 58 of the leg strap 56. The securing members 60 of the leg strap 56 comprise a hook and loop securing assembly.

Figure 6:
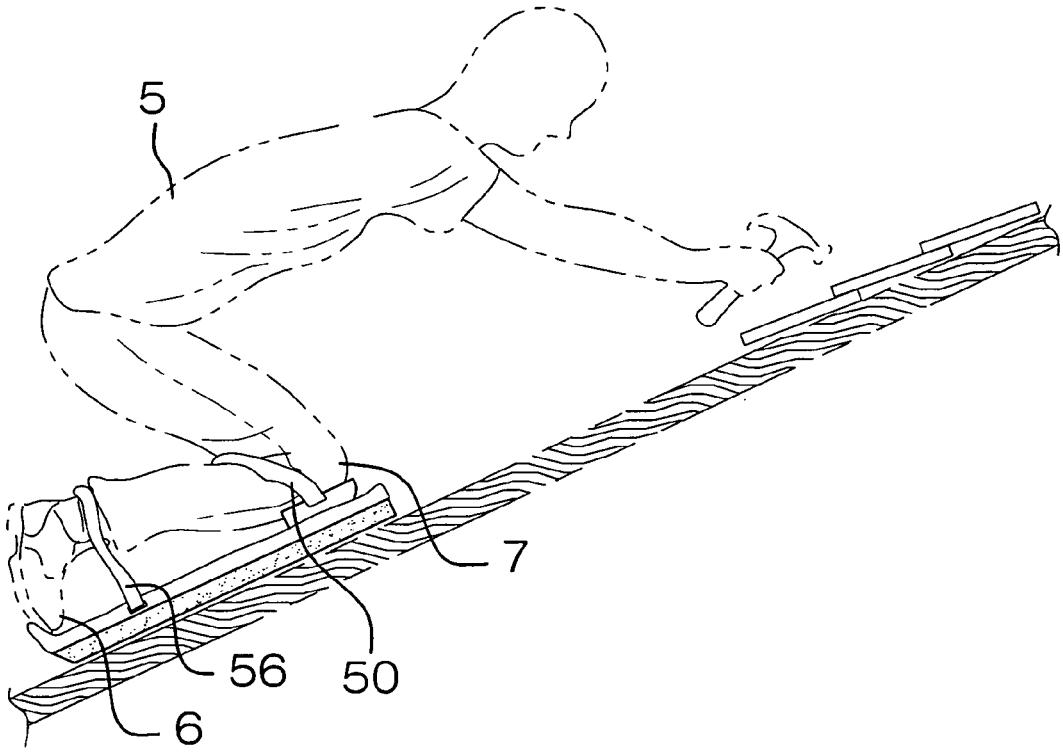
FIG. 6 is a side in-use view of the present invention.

In use, two of the apparatuses 10 are used; one for each of the person's knees. The user attaches the panel 30 to the top plate 12 so that the distance between the panel 30 and the lip 28 properly fits the distance between the knee 7 and the toe 6 of the person 5. The knee 50 and leg 56 straps are then attached to the leg. If the apparatus 10 is being used on a horizontal surface, the lower plate 46 is not used. If the apparatus 10 is being used on an angled surface, such as shown in FIG. 6, the lower plate 46 is attached to the top plate 12 to increase friction between the surface and apparatus 10.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A knee protector apparatus for providing protection for a person's knee from a support surface being kneeled on by the person, said apparatus including:

a top plate being rigid and having a top side, a bottom side, a front edge, a rear edge, a first lateral edge and a second lateral edge;

a panel for receiving the knee, said panel being attached to and selectively positioned on said top plate, said top side having a plurality of receiving wells therein being aligned along a line orientated parallel to said first lateral edge, said receiving wells being positioned nearer to said front edge than said rear edge, a male fastener being attached to a lower surface of said panel, said male fastener being positionable in one of said wells and attached to said top plate;

a lower plate being resiliently compressible and having a same shape and size as said top plate;

a coupler releasably coupling said lower plate to said top plate; and a knee strap extending through side edges of said panel, said knee strap being extendable around a leg of the person adjacent to the knee, securing members releasably securing together free ends of said knee strap.

2. The apparatus according to claim 1, further including a lip being attached to and extends upwardly from said top side, said lip being coextensive with said rear edge and defining a toe support, toes of the user being positionable against said lip to retain the person's foot on said top plate.

3. The apparatus according to claim 1, wherein said panel is comprised of a resiliently compressible material.

4. The apparatus according to claim 3, wherein said panel has a forward edge and a rearward edge, said forward edge directed toward said front edge when said panel is attached to the top side, an upwardly extending flange being attached to and being coextensive with said side and forward edges of said panel.

5. The apparatus according to claim 1, wherein said lower plate is comprised of a foamed elastomeric material.

6. The apparatus according to claim 1, wherein said coupler comprises a sleeve being attached to said lower plate and being coextensive with a perimeter edge of said lower plate, said sleeve being extended over said front, rear, first lateral and second lateral edges of said top plate to secure said lower plate to said top plate.

7. The apparatus according to claim 6, further including a leg strap extending through said first and second lateral edges of said top plate, said leg strap being extendable around a leg of the person adjacent to a foot of the person, securing members releasably securing together free ends of said leg strap.

8. The apparatus according to claim 1, further including a leg strap extending through said first and second lateral edges of said top plate, said leg strap being extendable around a leg of the person adjacent to a foot of the person, securing members releasably securing together free ends of said leg strap.

9. A knee protector apparatus for providing protection for a person's knee from a support surface being kneeled on by the person, said apparatus including:

a top plate being rigid and having a top side, a bottom side, a front edge, a rear edge, a first lateral edge and a second lateral edge, said top side having a plurality of receiving wells therein being aligned along a line orientated parallel to said first lateral edge, said receiving wells being positioned nearer to said front edge than said rear edge, a lip being attached to and extending upwardly from said top side, said lip being coextensive with said rear edge and defining a toe support, toes of the user being positionable against said lip to retain the person's foot on said top plate;

a panel for receiving the knee, said panel being attached to and selectively positioned on said top plate, said panel being comprised of a resiliently compressible material, said panel having a pair of side edges, a forward edge and a rearward edge, said forward edge being directed toward said front edge when said panel is attached to the top side, an upwardly extending flange being attached to and being coextensive with said side and forward edges of said panel, a male fastener being attached to a lower surface of said panel, said male fastener being positionable in one of said wells and attached to said top plate;

a lower plate being resiliently compressible and having a same shape and size as said top plate, said lower plate being comprised of a foamed elastomeric material;

a coupler releasably coupling said lower plate to said top plate, said coupler comprising a sleeve being attached to said lower plate and being coextensive with a perimeter edge of said lower plate, said sleeve being extended over said front, rear, first lateral and second lateral edges of said top plate to secure said lower plate to said top plate;

a knee strap extending through said side edges of said panel, said knee strap being extendable around a leg of the person adjacent to the knee, securing members releasably securing together free ends of said knee strap, said securing members comprising a hook and loop securing assembly;

a leg strap extending through said first and second lateral edges of said top plate, said leg strap being extendable around a leg of the person adjacent to a foot of the person, securing members releasably securing together free ends of said leg strap, said securing members of said leg strap comprising a hook and loop securing assembly.

* * * * *